United States Patent [19]

Lammers

[11] 4,320,081

[45] Mar. 16, 1982

[54] PROCESS FOR THE MANUFACTURE OF FIBRES FROM POLY-P-PHENYLENE TEREPHTHALAMIDE

[75] Inventor: Henri T. Lammers, Duiven, Netherlands

[73] Assignee: Akzo N.V., Arnhem, Netherlands

[21] Appl. No.: 155,595

[22] Filed: Jun. 2, 1980

[30] Foreign Application Priority Data

Jun. 8, 1979 [NL] Netherlands ..... 7904495

[51] Int. Cl.[3] ..... D01F 6/00

[52] U.S. Cl. ..... 264/184; 264/203; 524/422; 524/608; 524/606

[58] Field of Search ..... 264/184, 203; 260/30.8 R, 32.6 N

[56] References Cited

U.S. PATENT DOCUMENTS

| | | | |
|---|---|---|---|
| 3,227,792 | 1/1966 | Rosenthal et al. | 264/289.6 |
| 3,414,645 | 12/1968 | Morgan | 264/184 |
| 3,551,535 | 12/1970 | Henderson et al. | 264/28 |
| 3,671,542 | 6/1972 | Kwolek | 264/184 |
| 3,684,540 | 8/1972 | Henderson et al. | 264/28 |
| 3,767,756 | 10/1973 | Blades | 264/184 |
| 4,018,735 | 4/1977 | Nakagawa et al. | 260/29.1 R |
| 4,040,371 | 8/1977 | Cooper et al. | 112/420 |
| 4,075,269 | 2/1978 | Jones et al. | 264/184 |
| 4,162,346 | 7/1979 | Jones et al. | 428/364 |
| 4,199,642 | 4/1980 | Cooper et al. | 428/288 |

FOREIGN PATENT DOCUMENTS

| | | |
|---|---|---|
| 2134582 | 8/1972 | France . |
| 6507885 | 12/1965 | Netherlands . |
| 6515504 | 6/1966 | Netherlands . |
| 6818815 | 7/1970 | Netherlands . |
| 7205836 | 10/1972 | Netherlands . |
| 137128 | 4/1973 | Netherlands . |
| 163238 | 7/1975 | Netherlands . |
| 7508256 | 7/1975 | Netherlands . |
| 1175010 | 12/1969 | United Kingdom . |

*Primary Examiner*—Jay H. Woo

*Attorney, Agent, or Firm*—Stevens, Davis, Miller & Mosher

[57] ABSTRACT

A process for the manufacture of fibres from a polyamide entirely or substantially consisting of poly-p-phenylene terephthalamide, by spinning a spinning mass having a temperature of 20°–120° C. and consisting of a mixture of concentrated sulphuric acid having a strength of at least 96% by weight and, calculated on the weight of the mixture, at least 15% of polyamide having an inherent viscosity of at least 2.5, the spinning mass being downwardly extruded into a coagulation bath from a spinneret whose efflux side is positioned in a gaseous inert medium and shortly above the liquid surface of the coagulation bath. The spinning mass is prepared by the successive steps of cooling the concentrated sulphuric acid to below its solidifying point, combining the sulphuric acid thus cooled and the polyamide, intermixing the two substances into a solid state mixture and heating the resulting solid state mixture to spinning temperature.

14 Claims, No Drawings

PROCESS FOR THE MANUFACTURE OF FIBRES FROM POLY-P-PHENYLENE TEREPHTHALAMIDE

The invention relates to a process for the manufacture of fibres from a polyamide entirely or substantially consisting of poly-p-phenylene terephthalamide, by spinning a spinning mass having a temperature of 20°-120° C. and consisting of a mixture of concentrated sulphuric acid having a strength of at least 96% by weight and, calculated on the weight of the mixture, at least 15% of polyamide having an inherent viscosity of at least 2.5, the spinning mass being downwardly extruded into a coagulation bath from a spinneret whose efflux side is positioned in a gaseous inert medium and shortly above the liquid surface of the coagulation bath.

The wet spinning of a spinning mass containing 5-30% by weight of poly-p-phenylene terephthalamide in concentrated sulphuric acid having a strength of preferably 95-100% by weight at a temperature in the range of 20° to 100° C. is known from U.S. Pat. No. 3,154,610. The spinning mass then used is prepared by intermixing the sulphuric acid and the polymer at room temperature or at elevated temperature.

According to U.S. Pat. No. 3,414,645 the wet spinning of fully aromatic polyamides from, for instance, concentrated sulphuric acid can be improved by first passing the spinning mass having a polymer content of preferably 15-22% by weight and a temperature of 40°-130° C. through an air zone before allowing it to enter the coagulation bath. Thus a considerably higher spin draw ratio may be realized, which results in fibres having greatly improved properties. Also in that case the spinning mass used is prepared at elevated temperatures, viz. at 60°-90° C.

Also from more recent publications describing the spinning of concentrated solutions of poly-p-phenylene terephthalamide it appears that the spinning mass used in it is prepared at elevated temperature. Thus, according to Example 1 of U.S. Pat. No. 4,016,236, poly-p-phenylene terephthalamide having an inherent viscosity of 6.1 is stirred in vacuo for two hours at 70° C. in 99.3% sulphuric acid and subsequently deaerated, resulting in a spinning mass containing 18% polymer.

This solution is then extruded through a spinneret and passed through an air zone of 10 mm before it enters a coagulation bath containing 30%-aqueous sulphuric acid and kept at 3° C.

Although the above mentioned known processes make it possible to obtain poly-p-phenylene terephthalamide fibres having satisfactory properties, these processes have several disadvantages. For instance, the preparation of the spinning mass to be used for it, which has a high polymer concentration, calls for prolonged stirring or intensive kneading. Moreover, the high viscosity of the resulting solution makes it necessary to increase the temperature. As a result of prolonged stirring at elevated temperature the poly-p-phenylene terephthalamide will to a greater or lesser extent be decomposed by the concentrated sulphuric acid. The degree of decomposition will increase with increasing concentrated temperature and with time.

The decomposition of the polymer has a detrimental effect on the properties of the fibres spun from it. The decomposition of the polymer particularly leads to a deterioration of the mechanical properties. Also the thermal stability of the fibre made by the known processes is not quite satisfactory. It is therefore an object of the present invention to provide a process that does not display the draw backs of the known processes. Another object of the invention is to provide a fibre having improved properties. The foregoing objects and others are accomplished in accordance with this invention, generally speaking, by providing a process of the type indicated above, characterized in that the spinning mass is prepared by the successive steps of cooling the concentrated sulphuric acid to below its solidifying point, bringing the sulphuric acid thus cooled and the polyamide together and intermixing the two substances into a solid mixture, and heating the resulting solid state mixture to spinning temperature. The process now proposed has several advantages. The preparation of the spinning mass is less time consuming. Moreover, as a result of the mild temperature conditions during the preparation of the spinning mass there will be no or only a slight degradation of the poly-p-phenylene terephthalamide, so that a fibre having improved properties is obtained. Also the spinning process to be used according to the invention is simplified because the special preparation of the spinning mass permits a more rapid and more effective deaeration thereof. The number of breaks in the spun filament as a result of gas bubbles occluded in the spinning mass is consequently strongly reduced. Moreover, filtration of the spinning mass is facilitated as a result of its containing no or very little undissolved or partially dissolved polymer and the filters need be exchanged less frequently. Furthermore, the process according to the invention provides a poly-p-phenylene terephthalamide fibre displaying a considerably improved thermal behaviour.

The spinning mass used in the process according to the invention is prepared by first cooling concentrated sulphuric acid to below its solidifying point. In the process of cooling a liquid concentrated sulphuric acid generally at a certain temperature the formation of solid particles will start. After passing through a certain temperature range the liquid sulphuric acid will in the end be completely in the solid phase. The solidifying process will therefore not always take place at a constant temperature but may be accomplished over a range of temperatures. It is preferred that the concentrated sulphuric acid cooled to below its solidifying point in the process according to the invention should be entirely of largely in the solid phase prior to its being combined with the polyamide. In the case of supercooling, however, it also may be present as metastable liquid phase. Such a liquid phase, however, passes entirely or partially into the solid phase upon combining and mixing it with the polyamide.

By the solidifying point of concentrated sulphuric acid is to be understood within the scope of the invention the temperature at which for the first time a solid phase begins to form in the liquid sulphuric acid which is cooled with stirring. It has been found that in actual practice the solidifying point of concentrated sulphuric acid is always below the melting point. Values for the melting point and the solidifying point of concentrated sulphuric acid can be found in the literature. Table A gives values mentioned by R. Knietsch in Ber. dtsch. chem. Ges 34 (1901) pp 4099-4041 for a few sulphuric acid concentrations.

TABLE A

| sulphuric acid concentration % | melting point °C. | solidifying point °C. |
|---|---|---|
| 96.0 | −10 | −19 |
| 97.0 | −4 | −11 |
| 98.0 | 3 | −3 |
| 99.0 | 6 | 2 |
| 100.0 | 10 | 7 |

The sulphuric acid to be used in the process according to the invention may have any temperature below its solidifying point. Considering that there are economical and technical disadvantages to the use of extremely low temperatures, however, the temperature to be chosen will generally not be more than 50° C. below the solidifying point of the sulphuric acid to be used. The temperature of the sulphuric acid cooled down to below its solidifying point is preferably lower than 0° C. Moreover, to prevent premature melting of the solid sulphuric acid it is preferred that use should be made of sulphuric acid cooled down to at least 5° C. below its solidifying point. The temperature of the poly-p-phenylene terephthalamide to be combined with the sulphuric acid may be equal to, or higher or lower than room temperature, but need be so chosen that during the adding and the mixing processes the mixture remains in the solid state. Extremely high temperatures of the poly-p-phenylene terephthalamide to be combined with the sulphuric acid will therefore be avoided. To prevent any heat introduced into the system by the poly-p-phenylene terephthalamide or evolved in the mixing process from prematurely causing the mixture to melt it may be necessary to apply cooling during the process of bringing together the sulphuric acid and the polyamide and the mixing thereof. The temperature should preferably remain below the solidifying point of the sulphuric acid until the mixture has reached the homogeneity required for it to be used as spinning mass. If desired, the poly-p-phenylene terephthalamide, before it is combined with the sulphuric acid, may be cooled to below room temperature, for instance to below the solidifying temperature of the sulphuric acid. As such cooling will generally not be necessary, however, use is preferably made of poly-p-phenylene terephthalamide which is at room temperature. The preparation of the sulphuric acid cooled to below its solidifying point may be effected in various ways. The procedure is preferably such that the sulphuric acid is brought into a finely divided state before it is combined with the polyamide, which is also in a finely divided state, and mixed, By a finely divided state is to be understood within the scope of the invention a mass made up of particles which individually measure less than about 2 mm and preferably less than about 0.5 mm. Such particles may be bonded together to form conglomerates which during mixing are again split up into separate particles. Particularly, the finely divided sulphuric acid may be present in a state which strongly resembles that of snow. The sulphuric acid should always be so finely divided that upon mixing it with poly-p-phenylene terephthalamide it forms a mixture suitable to be used as spinning mass.

The sulphuric acid may consist of particles having larger dimensions, for instance in the form of chips or pellets, which are reduced in size before or during mixing with the polyamide. For instance, the liquid sulphuric acid may be cooled to below its solidifying point until it has changed into a solid mass, which is converted into smaller particles by a method known in itself in the art and with the aid of suitable crushing and/or grinding equipment. Alternatively, liquid sulphuric acid may be divided into very small drops, which may be cooled to below the solidifying point of the sulphuric acid, for instance by spraying into a cold atmosphere. Particularly suitable is a method which consists in that a liquid concentrated sulphuric acid is brought into a vessel provided with a cooling device and a stirrer and subsequently cooled, with stirring, to below its solidifying point until it has completely changed into a finely divided solid mass. The stirring during the cooling process gives rise to the formation of the solid snowlike sulphuric acid. In this form the sulphuric acid is very suitable to be mixed with finely divided poly-p-phenylene terephthalamide to obtain a homogeneous solid state mixture. Another method which is also very suitable, more particularly in continuous operations, consists in that a thin layer of liquid concentrated sulphuric acid is applied to the surface of a cooled roll and subsequently allowed to cool to below its solidifying point and finally removed from the roll surface with the aid of a scraping device. With this method the liquid sulphuric acid may be applied to the roll surface by spraying or by causing the roll to rotate while it is partially immersed in the liquid sulphuric acid. Not until the sulphuric acid has cooled to below its solidifying point is it combined with the polyamide and are the two substances intermixed.

Bringing the sulphuric acid and the polyamide together may be effected in various ways. The sulphuric acid may be added to the polyamide or inversely. It is also possible for the two substances simultaneously to be brought into a suitable space. The continuous preparation of the spinning mass may be carried out for instance with the aid of a mixer consisting of a housing provided with cooling elements and a rotary screw. Liquid sulphuric acid is fed into the inlet side of the housing, in which it is cooled. Into a following section, there where the temperature of the sulphuric acid has sufficiently decreased, the finely divided polyamide is added. The rotary screw will then also serve as mixing device. Then the solid mixture has reached the discharge side of the housing, it is sufficiently homogeneous to be used as spinning mass. Particularly suitable is the method by which into a vessel provided with a cooling device and a stirrer a liquid, concentrated sulphuric acid is introduced and subsequently converted, with stirring and cooling, into a snowlike mass and subsequently, with continued stirring, the finely divided polyamide is added.

Cooling the sulphuric acid and mixing it with polyamide preferably takes place under conditions such that a minimum amount of moisture is taken up from the environment. The work may be done in an atmosphere of dry air or dry inert gas. Although the preparation of the solid state mixture may be carried out at elevated or reduced pressure, it is preferably done at atmospheric pressure.

Essential to the process according to the invention is that use is made in it of a spinning mass which is prepared by intermixing poly-p-phenylene terephthalamide and concentrated sulphuric acid in the solid state. Preferably, not until the sulphuric acid and the polyamide have completely been intermixed to a homogeneous mixture is the temperature of the mixture allowed gradually to rise to above the melting point of the sulphuric acid used. Although melting of the solid sulphuric acid particles might be expected to give rise to the formation of a liquid sulphuric acid phase, such a phase is not noticeable in actual practice. In spite of the present mixtures of concentrated sulphuric acid and poly-p-phenylene terephthalamide generally consisting of 75 to 85% by weight of concentrated sulphuric acid, they have, even at temperatures above the melting point of the sulphuric acid used, for instance above room temperature, a dry and sandy character. Apparently the sulphuric acid present is entirely adsorbed by the polymer particles. For such a mixture to be spun it must, of course, be heated to a higher temperature. Depending on the composition of the polymer, the concentration and the inherent viscosity of the polymer, the temperature would have to be in the range of 20° to 120° C.

To obtain the advantages of the process according to the invention it is necessary but not sufficient that concentrated sulphuric acid and poly-p-phenylene terephthalamide should be intermixed at a temperature below the solidifying point of the sulphuric acid. Essential to the invention is that the concentrated sulphuric acid is cooled down to below its solidifying point before it comes into contact with the polyamide. Bringing together liquid sulphuric acid having a temperature above its solidifying point and finely divided poly-p-phenylene terephthalamide followed by stirring at a temperature below the solidifying point of the sulphuric acid will generally result in obtaining a non-homogeneous mixture which is not or hardly suitable for spinning purposes. In this connection attention should still be drawn to the Netherlands Patent Application No. 7 508 256 in which according to comparative example II 2.2 grammes of poly-p-phenylene terephthalamide having an inherent viscosity of 5.41 are mixed with 78 grammes of 100%-sulphuric acid. Although mixing is carried out at 0° C., the procedure adopted is not the same as the one according to the present invention. Despite the fact that in this known process the mixture has only a low polyamide content (less than 3%), it is non-homogeneous, even upon heating to 80° C. Spinnability becomes satisfactory only upon heating to 130° C., which however gives rise to a considerable decrease in viscosity. On the basis of these unfavourable results it is proposed in the above-mentioned Netherlands Patent Application that instead of employing poly-p-phenylene terephthalamide use should be made of a copolyamide containing at least 5 mole % of non-para oriented structural units.

In the process according to the invention use is made of a polyamide entirely or substantially consisting of poly-p-phenylene terephthalamide. By a polyamide which entirely or substantially consists of poly-p-phenylene terephthalamide is to be understood within the scope of the invention the homopolymer poly-p-phenylene terephthalamide and any copolyamide containing more than 95 mole % p-phenylene terephthalamide units. Besides the p-phenylene terephthalamide units said copolyamide contains other aromatic or aliphatic chain constituents, for instance substituted or unsubstituted para- and meta-phenylene groups and naphthylene or butylene groups, provided that the presence of these groups does not unduly detract from the properties of the fibres made from such a copolyamide. It is preferred that the homopolymer poly-p-phenylene terephthalamide be used.

The polyamides to be used in the process according to the invention may contain the usual additives, such as antioxidants, light-fastness improving agents, pigments and the like. These substances may, if desired, also be added during or after the preparation of the mixture from solid sulphuric acid and polyamide.

The polyamides to be used in the process according to the invention may be prepared by the methods known in the art.

Poly-p-phenylene terephthalamide is preferably prepared from p-phenylene diamine and terephthaloyl chloride in a medium of N-methyl-pyrrolidone and at least 5% calcium chloride, as described in the British Pat. No. 1 547 802. The resulting poly-p-phenylene terephthalamide together with the other constituents of the reactions system form a crumbly mass. After this mass has been intimately mixed with a coagulating agent, such as water, the polymer can be isolated by filtration, purified by washing and finally dried. In this way poly-p-phenylene terephthalamide is obtained in the form of a powdered solid substance. In the process according to the invention this finely divided state makes it very suitable to be mixed with finely divided, solid, concentrated acid.

The inherent viscosity of the polyamide to be used in the process according to the invention should be at least 2.5 in view of the required mechanical properties of the fibres to be made. It is preferred that the inherent viscosity of the poly-p-phenylene terephthalamide should be at least 3.5.

As in the process according to the invention the preparation of the spinning mass is effected by mixing solid substances, it is also very suitable to be employed for the processing of polyamides having very high inherent viscosities, for instance of 5.0–7.0 and in some cases up to 10 or higher.

The sulphuric acid to be used according to the invention has a strength of at least 96% by weight. Optionally, use may be made of concentrated sulphuric acid containing up to 20% by weight of free $SO_3$.

As the solidifying point of sulphuric acid having a concentration of 98–100% by weight is fairly close to room temperature, the use of concentrations in this range is preferred. In that case, by making use of liquid sulphuric acid of room temperature, relatively little cooling is needed in the preparation of solid sulphuric acid.

The process according to the invention lends itself particularly to using sulphuric acid having a concentration of about 98% by weight. Sulphuric acid so composed is obtained as azeotropic mixture in the distillation of mixtures of sulphuric acid and water. It is formed, for instance, if the sulphuric acid used in the process according to the invention is recovered by separating the coagulation bath liquid consisting of dilute aqueous sulphuric acid into water and concentrated sulphuric acid by means of distillation. The resulting azeotropic mixture can be used again for the preparation of a spinning mass as employed in the process according to the invention. Thus, also the problem is solved of the large amount of waste acid formed during spinning poly-p-phenylene terephthalamide.

According to the invention the azeotropic sulphuric acid mixture is first brought into a finely divided state, in which it is mixed with finely divided poly-p-phenylene terephthalamide. In this way it is possible in a short time to obtain a mixture of solid substances which upon heating to the desired spinning temperature can without any problems be spun into fibres having good mechanical properties and a good thermal stability.

In the process according to the invention the concentration of the polyamide in the spinning mass is at least 15%, calculated on the weight of the spinning mass. It is preferred that the concentration of the polyamide should be kept as high as possible in order to reduce the usage of sulphuric acid and to attain maximum output capacity of the dissolving and spinning equipment and further in view of the fact that the tensile strength of the resulting fibres generally increases with increasing concentration of the polyamide in the spinning mass. The process according to the invention is particularly suitable for processing a spinning mass which contains a high percentage of poly-p-phenylene terephthalamide. Although such a spinning mass generally also may be prepared by using known processes in which the polymer is mixed with liquid sulphuric acid, such a preparation is rather time consuming. When poly-p-phenylene terephthalamide is dissolved in liquid sulphuric acid, a viscosity maximum is passed, as has long been known for solutions which pass from the optical isotropic state into an optical anisotropic state. To pass this viscosity maximum known processes are generally carried out at elevated temperature. In the process according to the invention the use in the preparation of the spinning mass of high-viscous liquid is completely avoided, the polymer and the sulphuric acid being intermixed in the solid instead of in the liquid phase.

The process according to the invention is preferably applied in such a way that calculated on its total weight, the spinning mass contains 16 to 21% of the polyamide. Alternatively, by mixing finely divided, solid, concentrated sulphuric acid with finely divided polyamide it is possible to prepare mixtures having a higher polyamide concentration of, for instance up to about 30% by weight. The man skilled in the art is capable of finding out which of these mixtures are still spinnable and what appropriate spinning conditions must be chosen.

The process according to the invention may be carried out continuously or discontinuously. In the continuous process the solid mixture of sulphuric acid and polyamide is, immediately upon being prepared, fed to a suitable spinning apparatus. In the discontinuous process according to the invention the solid mixtures obtained upon mixing the sulphuric acid and polyamide are not immediately processed into fibres but first stored and only spun at a later stage. In the period between their preparation and their spinning the solid mixtures are preferably kept under a dry gas atmosphere at room temperature. If desired, separately prepared batches of the solid mixtures may be intermixed then.

Before the spinning mass consisting of sulphuric acid and polyamide is spun, it should be heated to a temperature at which it is sufficiently fluid to be processed. Depending on the composition of the spinning mass this temperature is in the range of 20° to 120° C. It is preferred that the temperature of the liquid mass to be spun should be in the range of 70°–100° C.

In general it is necessary for the gaseous constituents, particularly air, contained in the spinning mass to be thoroughly removed before spinning. Air bubbles left behind in the spinning mass gravely disturb the spinning process in that they give rise to filament breaks. The removal of the gaseous constituents from the spinning mass may be effected by methods known in themselves. For instance, the liquid spinning mass heated to spinning temperature may be stirred under reduced pressure. In view of the high viscosity of the spinning mass to be used, however, this method does not make it possible completely to remove the air, even when use is made of long deaeration times.

According to a preferred embodiment of the process according to the invention the gaseous constituents present in the mixture of finely divided solid sulphuric acid and finely divided polyamide are entirely or largely removed before the mixture is heated to spinning temperature. During the removal of the gaseous constituents the solid mixture may have a temperature equal to or lower or higher than the solidifying point of the sulphuric acid used, provided that the temperature is below the temperature at which the mixture becomes fluid. It is preferred that the deaeration be carried out at room temperature. As it is possible in the process according to the invention for the deaeration to take place in the solid mixture of sulphuric acid and polyamide, it proceeds much faster than in the case of a liquid mixture having a high viscosity. As moreover the deaeration also may be far more complete, the number of broken filaments as a result of air bubbles occluded in the spinning mass is greatly reduced. Thus the invention leads to a stabler spinning process with fewer spinning faults. Moreover, it leads to an improved quality of the product obtained.

The spinning mass deaerated and heated to spinning temperature is spun by the long known method of dry jet-wet spinning. This method is described in more detail for instance in the afore-mentioned U.S. Pat. Nos. 3,414,645 and 4,016,236.

This method comprises extruding the liquid spinning mass into a non-coagulating gaseous atmosphere, such as air, and immediately afterwards into a coagulation bath. In the air zone through which the spinning mass passes the polyamide is drawn to a high degree, so that its chain molecules are oriented in longitudinal direction of the fibre formed. After their coagulation the filaments formed are removed from the coagulation bath, washed acid free, dried and taken up on a bobbin. The spinnerets that are used in the process according to the invention may be of a type known in itself in the dry jet-wet spinning of fully aromatic polyamides. The length of the distance in the gaseous non-coagulating medium between the outflow side of the spinning orifices and the surface of the coagulation liquid bath may vary from about 1 to 100 mm and is for instance in the range of 3 to 20 mm. The gaseous non-coagulating medium preferably consists of air.

The composition of the coagulation bath may vary. It may entirely or partly consist of water or other substances, such as bases, acids, salts and organic solvents. The coagulation bath preferably consists of dilute aqueous sulphuric acid having a concentration of 0–40% by weight.

The temperature of the coagulation bath may have any value desired. Depending on the other spinning conditions the temperature of the coagulation bath is generally in the range of −10° to +50° C. and preferably between 0° and 25° C.

In the process according to the invention the spinning mass leaving the spinning orifices is drawn in the non-coagulating gaseous medium. The degree of drawing, that is the ratio between the speed of the filaments upon leaving the coagulation bath and the average speed of the spinning mass upon leaving the spinning orifices is 1.9 up to 10 or higher. Increasing the degree of drawing will generally result in an increase in the tenacity and the initial modulus of the spun fibre and a decrease of the elongation at break. Depending on the other spinning conditions the degree of drawing is so chosen that as far as fibre properties are concerned optimum results are obtained.

As small amounts of acid have a detrimental influence on the fibre properties, the sulphuric acid used should completely be removed from the spun fibres. This may be done by subjecting them to a treatment at room temperature or at elevated temperature with water and/or solutions of alkaline substances, for instance soda. After they have been washed, the fibres are dried. This may be done in any convenient way. It is preferred that the drying should be carried out immediately after washing by passing the fibres over heated rollers.

Optionally, the dried fibres may still be subjected to a heat treatment, in which the fibres are heated under tension in an inert or non-inert gas at a temperature in the range of 300° to 550° C. Such a heat treatment leads to reduced elongation at break of the spun fibres and to an increase in initial modulus.

During the spinning process usual substances may be applied to or incorporated into the fibres, such as lubricants, anti-static agents, pigments, adhesion-to-rubber improving substances and the like.

A skilled man in the field of wet spinning is capable of choosing such an apparatus and such process conditions as in the use of the process according to the invention lead to optimum fibre properties.

In addition to the above-mentioned merits of the process according to the invention it is of great advantage that use of this process moreover leads to a novel fibre having an improved resistance to the action of heat.

By fibres are to be understood within the scope of the invention all usual fibre types, such as filaments of practically unlimited length, filaments yarns composed of one or more twisted or non-twisted filaments, tow made up of a collection of a large number of filaments which are bundled practically without any twist being imparted to them, and the like.

Filaments of practically unlimited length formed during spinning may, if desired, be cut into staple fibres, which may in their turn be processed into spun yarns.

Fully aromatic polyamides, more particularly polyamides which entirely or substantially consist of poly-p-phenylene terephthalamide, generally having a good resistance to the action of heat, are often used under conditions in which they are exposed to high temperatures. Under such conditions it is of importance that the mechanical properties of the fibres should as much as possible be maintained. Particularly the tenacity should decrease as little as possible. A good resistance to heat is also important in cases where the fibres are exposed to high processing temperatures. For instance, while yarns from poly-p-phenylene terephthalamide are processed into reinforcing materials for automobile tires or plastics articles, they are exposed to high temperatures. Also in that case the tenacity should decrease as little as possible.

It is known that by taking special steps the heat resistance of fibres from poly-p-phenylene terephthalamide may be improved, especially if the sulphuric acid left in the spun and washed fibre is completely neutralized and the salt formed in the neutralization process is completely removed. Although the resulting fibres are quite suitable for use in actual practice, there was need for a further reduction of their sensitivity to the action of elevated temperatures. This need is met by the present invention. The invention provides a fibre made from a polyamide entirely or substantially consisting of poly-p-phenylene terephthalamide and having an inherent viscosity of at least 2.5, which fibre has a tenacity of at least 10 cN/dtex, an elongation at break of at least 2.7%, an initial modulus of at least 300 cN/dtex and a heat sensitivity index not higher than 12.

The heat sensitivity index is a number quantitatively characterizing the behaviour of fibres with respect to their tenacity at elevated temperature. In the experimental determination of the heat sensitivity index the fibres are subjected to a heat treatment under accurately described conditions which correspond to the thermal conditions under which the fibres are often used as reinforcing material. The heat sensitivity index of a fibre decreases with increasing resistance to elevated temperature. The most unfavourable situation with respect to the tensile strength at elevated temperature is represented by a heat sensitivity index of 100. In general the heat sensitivity index is dependent on the nature of the polymer from which the fibres are made and on the conditions during the manufacture of these fibres. Thus, the heat sensitivity index of known fibres from poly-p-phenylene terephthalamide generally varies from about 15 to 60, depending on the manner in which the sulphuric acid has been removed from the fibre during manufacture. Also if the sulphuric acid left in the fibre is completely neutralized and the resulting salt is removed as far as possible, the known fibres will always have a heat sensitivity index of 15 or higher. It was therefore very surprising that the use of the process according to the invention made it possible to obtain a novel poly-p-phenylene terephthalamide fibre which, compared with corresponding, known fibres, has a considerably improved resistance to elevated temperatures in that it has been found to have a heat sensitivity index not higher than 12. This improved heat resistance is obtained according to the invention without having to incorporate into the fibre any special heat stabilizer, antioxidant or any other additive.

Although it is not clear how the improved heat sensitivity index obtained according to the invention should be explained, it may be assumed that this improvement is connected with the very mild conditions under which the spinning mass is prepared in the presence according to the invention.

The fibre having improved resistance to heat obtained according to the invention preferably consists of poly-p-phenylene terephthalamide having an inherent viscosity of at least 3.5 and preferably has a tenacity of at least 17 cN/dtex, an elongation at break of at least 3.5% and an initial modulus of at least 350 cN/dtex.

The heat sensitivity index of the fibre according to the invention is preferably not higher than 10.

The favourable thermal properties of the fibres manufactured according to the invention are reflected particularly if these fibres are processed into cord. This is evident from the high strength which after twisting and cabling is left in the dipped cord, i.e. the cord provided with an adhesive. As is known, the most important application of poly-p-phenylene terephthalamide is formed by reinforcing cord for elastomeric objects, such as pneumatic tires for vehicles. The great importance of the favourable cord properties of the product made according to the invention is particularly manifest if it is considered that the strength of the dipped cord is a measure of its scope of application as reinforcing material in rubber, more particularly in pneumatic tires for vehicles.

The invention particularly provides a filament bundle which consists of endless filaments of a polyamide which substantially consists of poly-p-phenylene terephthalamide and has an inherent viscosity of at least 2.5, the filaments having a tenacity of at least 10 cN/dtex, an elongation at break of at least 2.7% and initial modulus of at least 300 cN/dtex, which filament bundle is characterized in that a symmetrical cord, more particularly a two-ply symmetrical cord, formed from these filaments has a cord efficiency of at least 75%, and by preference 80% or higher, when such a cord has a twist factor of about 16500 and the surface of the cord filaments is provided with an adhesive. The adhesive is preferably applied to the surface of the filaments at a temperature of at least 200° C., more particularly at 240°–250° C., with the threads or filaments of the drawn thread bundle preferably having a linear density not higher than 2.5 decitex, more particularly 1.0 to 2.0 decitex. Said adhesive, which promotes the adhesion of the filaments to rubber, is preferably formed by one or more of the following substances: modified or unmodified epoxy resins, polyhydrazides, polyurethane resins and polysulphides. According to the invention the adhesive substantially consists of polyamide epoxy resins which may contain a blocked polyisocyanate, in combination or not with resins based on resorcinol-formaldehyde-resol and/or styrene-butadiene-vinyl pyridine.

The product obtained by the process according to the invention may be applied in all cases where use is made generally of fibres prepared from fully aromatic polyamides and having a high tenacity and a high initial modulus, such as reinforcing material in plastics articles, tires, V-belts and hose material and in cables, ropes, woven fabrics, knitted fabrics, webs and the like.

The inherent viscosity ($\eta_{inh}$) of the polyamide is defined by the equation $$\eta_{inh} = \frac{\ln \eta_{rel}}{0.5}$$

where $\eta_{rel}$ is the ratio of the efflux time of a solution of the polyamide (0.5 g polyamide in 100 ml 96%-sulphuric acid) to that of the pure solvent measured in a capillary viscometer at 25° C.

The tenacity, the elongation at break and the initial modulus of the fibres in accordance with ASTM D885 were measured on a single filament, on non-twisted yarn formed by a bundle of single filaments or on a dipped cord with the aid of an Instron tensile tester (Instron Engineering Corp., Canton, Mass., U.S.A.). The yarns to be tested were previously given a twist of 90 t/m. Before carrying out the tests the samples were all conditioned for 16 hours at a temperature of 20° C. and a relative humidity of 65%. The tests were carried out in a space conditioned in the same manner. The tensile tests were carried out fivefold on samples having a length between clamps of 50 cm and at a constant tensile rate of 5 cm/min.

The linear density of a fibre sample was determined by weighing a certain length (100 cm under a tension of 0.1 cN/dtex) of the sample.

By the twist factor (Tg) is meant the value:

$$Tg = n\sqrt{\frac{\text{linear density}}{\text{specific mass}}}$$

where n is the cord twist in turns per meter and the linear density is expressed in decitex. The specific mass is 1.44 g/cm$^3$ for usual filaments from poly-p-phenylene terephthalamide.

By cord efficiency is to be understood:

$$\frac{\text{tenacity of the dipped cord}}{\text{tenacity of the starting yarn}} \times 100$$

where both strengths are expressed in cN/dtex.

With respect to the determination of the cord efficiency it should be added that by a dipped cord is to be understood a cord obtained by using the dip procedure and the dip liquids as described in Example VI.

The heat sensitivity index was determined as follows. As test specimen a non-twisted sample was used. On 2 glass reels there were each wound 100 m of the fibre sample while kept under a tension of 0.01 cN/dtex. If the sample was a yarn made up of a number of filaments, it was previously given a twist of 90 t/m. The reels with the fibre sample were placed on a rotating disk (30 r.p.m.), which was placed in an oven at a temperature of 250° C. The fibre samples were homogeneously heated for 1 hour at that temperature in the presence of air.

After cooling outside the oven the tenacity was determined fivefold on each of the samples in the aforedescribed way.

Subsequently, of each sample the average result was calculated. Finally, the results of the two samples were averaged. From the tenacity value thus obtained after heatin ($T_2$), expressed in cN/dtex, and the original tenacity ($T_1$) of the sample prior to the heat treatment at 250° C. the heat sensitivity index (H.S.I.) was calculated as follows:

$$H.S.I. = \frac{100(T_1 - T_2)}{T_1}$$

The invention will be further described in the following examples.

EXAMPLE I

Preparation of the polyamide

Poly-p-phenylene terephthalamide was prepared from p-phenylene diamine and terephthaloyl dichloride. As reaction medium a mixture of N-methyl pyrrolidone and calcium chloride was used. The preparation was carried out in the same way as described in Example 6 of the British Pat. No. 1 547 802, but on a larger scale. The coagulation of the polymer obtained was carried out by adding to the reaction mixture 10 kg water per kg polymer and vigorously stirring the mixture. The resulting polymer suspension was filtered off, washed, and dried at 120° C. Thus, a powdered product was obtained having a particle size not greater than 0.1 mm. The inherent viscosity of the resulting poly-p-phenylene terephthalamide was 5.53.

Manufacture of the fibres

Liquid concentrated sulphuric acid having a strength of 99.8% by weight was applied to the surface of a rotating roll which was internally cooled with brine down to about −10° C. On the roll surface there formed a thin layer of solid sulphuric acid. This was scraped off in the form of flakes. The solid sulphuric acid was transferred to a mixing vessel provided with a screw mixer and a cooling device, in which vessel the temperature was kept at about 10° C. below the solidifying point of the sulphuric acid. To the solid sulphuric acid in the mixing vessel there was subsequently added the poly-p-phenylene terephthalamide in an amount of 1 kg polymer per 4.25 kg solid sulphuric acid. This corresponds to 19% by weight of poly-p-phenylene terephthalamide, calculated on the total weight of sulphuric acid and polyamide together. Polyamide and solid sulphuric acid were intensively mixed over a period of 30 minutes until a homogeneous, solid, powdered mixture was obtained, the temperature being kept at about 10° C. below the solidifying point of the sulphuric acid. Next, with continued mixing, the temperature of the mixture was allowed to rise to above the solidifying point of the sulphuric acid. In this way a sandy, homogeneous mixture was formed. This mixture was subsequently deaerated and heated to spinning temperature in a single-screw extruder. The temperature in the extruder was kept at 80° C. In total residence time of the liquid spinning mass at 80° C. up to its being spun was about 20 minutes. From the extruder the liquid spinning mass was pumped through a filter and a spinning pump to a spinneret. The spinneret had 1000 spinning orifices each having a diameter of 60 μm.

After the spinning mass had left the spinning orifices, it passed through the air zone 8 mm long before entering a coagulation bath consisting of 5% by weight aqueous solution of sulphuric acid at a temperature of about 10° C. The filaments thus formed were subjected to successive treatments by thoroughly washing them with a dilute soda solution and water, drying them with the aid of a drum heated at 120° C. and winding them at a speed of 150 m/min. The resulting yarn had the following properties:

| | |
|---|---|
| Inherent viscosity | 5.50 |
| Linear density | dtex 1885 f1000 |
| Tenacity | 18.7 cN/dtex |
| Elongation at break | 3.85% |
| Initial modulus | 420 cN/dtex |
| Heat sensitivity index | 4 |

EXAMPLE II (COMPARATIVE EXAMPLE)

The experiments as described in Example I were repeated, but in such a way that the spinning mass was prepared by the following prior art methods.

A. Powdered poly-p-phenylene terephthalamide having an inherent viscosity of 5.53 and liquid 99.8% by weight sulphuric acid were brought together in a mixing vessel at room temperature, and heated under vacuum to 70° C. at which temperature it was stirred for 2 hours. Subsequently, the mixture was allowed to stand for 2 hours and deaerated. Next, it was spun as described in Example I. The spinning mass contained 19% by weight of poly-p-phenylene terephthalamide. The resulting yarn had the following properties:

| | |
|---|---|
| Inherent viscosity | 5.23 |
| Linear density | dtex 1928 f1000 |
| Tenacity | 18.4 cN/dtex |
| Elongation at break | 3.60% |
| Initial modulus | 415 cN/dtex |
| Heat sensitivity index | 16 |

B. Powdered poly-p-phenylene terephthalamide having an inherent viscosity of 5.53 and liquid 99.8% by weight sulphuric acid were brought together in a mixing vessel in which they were mixed as well as was possible at room temperature. An inhomogeneous doughy mixture was obtained. To change it into a spinnable mass the mixture was heated to 95° C., at which temperature it was forced ten times through a fine mesh filter gauze pack over a period of 2 hours. The spinning mass thus obtained contained 19% by weight of poly-p-phenylene terephthalamide. After deaeration this spinning mass was spun as described in Example I. The resulting yarn had the following properties:

| | |
|---|---|
| Inherent viscosity | 5.07 |
| Linear density | dtex 1780 f1000 |
| Tenacity | 17.1 cN/dtex |
| Elongation at break | 3.50% |
| Initial modulus | 410 cN/dtex |
| Heat sensitivity index | 25 |

The results of these experiments show that the yarns made by the prior art method have a heat sensitivity index higher than 15.

EXAMPLE III

Into a planetary mixer having a capacity of 6 l and provided with a cooling jacket there were charged 2550 g of liquid 99.8% by weight sulphuric acid at room temperature. The sulphuric acid was cooled, with stirring, until the first small crystals began to form in it. Cooling and stirring was kept up until the sulphuric acid had entirely changed into a snowlike mass having a temperature of −1° C. Then 450 g of finely divided poly-p-phenylene terephthalamide having an inherent viscosity of 4.22 were added to the sulphuric acid snow. With continued cooling the sulphuric acid snow was mixed with the finely divided polyamide over a period of 30 minutes. Subsequently, with continued stirring, the temperature of the polyamide sulphuric acid mixture was allowed to rise to room temperature. In this way a dry, sandy, non-sticking mass was obtained, in which the polyamide content was 15% by weight. This mass was fed to an extruder in which the solid spinning mass was deaerated, heated to 60° C. and further homogenized. To prevent the spinning mass from sticking the in-feed end of the extruder was cooled to −5° C. The spinning mass flowing out of the extruder was transported through a fine mesh gauze pack and a spinning pump to a spinneret. The spinneret was provided with 96 orifices each measuring 75 μm in diameter. The spinning mass left the spinning orifices in a vertically downward direction at a rate of 20 m/min, passed through an air zone 10 mm in length and was subsequently fed into an aqueous coagulation bath having a temperature of 20° C. In the coagulation bath the filaments that had formed passed through a vertically positioned spinning tube having a length of 25 cm and a diameter of 8 mm. The spun yarn was washed acid free with water of 90° C., dried at 140° C. and taken up on a bobbin. The draw ratio during spinning was 5.5.

The yarn obtained had the following properties:

| | |
|---|---|
| Tenacity | 10.60 cN/dtex |
| Elongation at break | 2.7% |
| Initial modulus | 350 cN/dtex |
| Heat sensitivity index | 9 |

EXAMPLE IV

This example demonstrates the preparation and the spinning of the spinning mass in which as solvent for the polyamide an azeotropic mixture of sulphuric acid and water was used.

A mixture of water and approximately 5% by weight of sulphuric acid was separated into water and an azeotropic mixture of sulphuric acid and water (sulphuric acid content: 98.3% by weight) by means of fractional distillation. The resulting sulphuric acid was converted into a snowlike mass having a temperature of −10° C. in the manner described in Example III.

Subsequently, powdered poly-p-phenylene terephthalamide having an inherent viscosity of 5.53 was added and mixed, with continued stirring, over a period of 30 minutes. Next, the temperature of the polyamide sulphuric acid mixture was allowed to rise to room temperature, with stirring. The mass thus obtained contained 18.6% by weight of poly-p-phenylene terephthalamide.

The mass was subsequently spun in the manner described in Example III at a spinning temperature of 80° C., a draw ratio of 9.0 and a temperature of 12° C. of the coagulation bath. The coagulation bath consisted of 5% by weight sulphuric acid.

The azeotropic mixture of sulphuric acid and water obtained from it by distillation could be used for further spinning experiments.

The yarn obtained had the following properties:

| | |
|---|---|
| Tenacity | 19.1 cN/dtex |
| Elongation at break | 3.50% |
| Initial modulus | 480 cN/dtex |
| Heat sensitivity index | 5 |

EXAMPLE V

Sulphuric acid having a strength of 97.5% by weight was converted into a snowlike mass having a temperature of −12° C. in the manner described in Example III. With continued cooling and stirring a powdered poly-p-phenylene terephthalamide having an inherent viscosity of 5.57 was added and the sulphuric acid snow was mixed with the polyamide for 30 minutes until a solid mixture was obtained. Subsequently, with stirring, the temperature of the mixture was allowed to rise to room temperature. The resulting mass contained 18.5% by weight of poly-p-phenylene terephthalamide.

The mass was subsequently spun under the conditions given in Example IV into a yarn having the following properties:

| | |
|---|---|
| Tenacity | 18.1 cN/dtex |
| Elongation at break | 3.60% |
| Initial modulus | 450 cN/dtex |
| Heat sensitivity index | 5 |

EXAMPLE VI

A yarn A was made by the method described in Example I. A yarn B was made by the method described in Example II A (comparative example). Of the two yarns A and B two cord constructions I and II were made, with the cords having as twist factor 16500.

The cord dipping was carried out in accordance with the following procedure. The percentages in which the ingredients of the composition are expressed are by weight. A set of adjacent undipped cords were fed to a trough which was filled with a pre-dip liquid in which the cords were guided over a roller. After leaving the pre-dip bath the cords, while under a tension of 25 mN/tex, passed through an oven in which they resided for 120 seconds at a temperature of 150° C. Subsequently, the cords, while under a tension of 25 mN/tex, were subjected to a heat treatment for 60 seconds in a second oven. Next, the cords were passed via a guide roller through a trough filled with a main-dip liquid. After leaving the main-dip bath the cords were treated in a third oven for 60 seconds at 235° C. while under a tension of 25 mN/tex. Upon leaving this oven the dipped cords were assembled and they were ready for various uses, such as the reinforcement of elastomeric objects, more particularly pneumatic tyres for vehicles. The preparation and composition of the used pre-dip liquid were as follows:

| | |
|---|---|
| demineralized water | 86.00% |
| NaOH 5% | 2.00% |
| caprolactam | 10.00% |
| Shell Epikote 812 (diglycidyl ether of glycerol) | 2.00% |
| | 100% |

In the order in which they are enumerated these components were brought together with stirring. Subsequently, the resulting liquid was allowed to condense for at least 12 hours at room temperature. The liquid then obtained was suitable to be used as pre-dip.

The preparation and the composition of the main-dip liquid were as follows:

A resin mixture consisting of:

| | |
|---|---|
| demineralized water | 40.82% |
| NaOH 5% | 1.06% |
| resorcinol | 1.93% |
| formalin 37% | 2.76% |

was allowed to condense for 6 hours ±15 min. at 24°–25° C., with the pH being 7–7.5. The resin mixture was subsequently added, with stirring, to a latex mixture consisting of:

| | |
|---|---|
| demineralized water | 7.41% |
| 40% latex of Gentac (a terpolymer of 70% butadiene, 15% styrene and 15% vinyl pyridine) | 43.80% |
| ammonia abt 25% | 2.22% |

Before use the resulting mixture was cooled for 15 hours at a temperature of 5°–10° C. Subsequently, it was diluted with water, 1 part by weight of water being used to 4 parts by weight of the mixture. The mixture obtained was suitable to be used as main-dip liquid.

The properties of the dipped cord are summarized in Table B.

TABLE B

| | Yarn A (according to the invention) | Yarn B (not according to the invention) |
|---|---|---|
| Dipped cord I | 1885 × 2(300Z/330S) | 1928 × 2(300Z/330S) |
| Tenacity mN/tex | 1600 | 1270 |
| Elongation at break % | 4.53 | 3.91 |
| Cord efficiency | 86% | 69% |

TABLE B-continued

| | Yarn A (according to the invention) | Yarn B (not according to the invention) |
|---|---|---|
| Dipped cord II | 1885 × 3(270Z/270S) | 1928 × 3(270Z/270S) |
| Tenacity mN/tex | 1450 | 1170 |
| Elongation at break % | 4.5 | 4.2 |
| Cord efficiency | 78% | 64% |

Comparison of the yarns A and B shows that the cord efficiencies for the yarn A according to the invention are 86% and 78%, the cord efficiencies for the yarn B (not according to the invention) being 69% and 64%. In connection with the favourable cord efficiency of at least 75% of the cords according to the invention, mention should still be made of Example 6 of U.S. Pat. No. 4,016,236, which gives the % tenacity ratio between a cord and filaments not in the form of a cord. The tenacity ratios of about 75% mentioned in said U.S. Patent, however, were obtained by using a different process, in which the emphasis is on the aftertreatment of the filaments after leaving the coagulation bath when, more particularly, the filaments are, without applying any tension to them, washed and dried and optionally heat-treated. Moreover, the tenacity ratios mentioned in the U.S. Patent were measured on non-dipped cord, so that they cannot be compared with the cord efficiency values measured on dipped cord that were attained by the process according to the invention. Nor can the tenacity values mentioned in said U.S. Patent for the undipped products subjected to a heat treatment be used for a comparison with the values of the heat sensitivity index obtained according to the present invention.

The heat sensitivity index according to the present invention applies to the behaviour of a sample containing no or only a very low twist (90 t/m) in a substantially tensionless state at 250° C. The heat treatment carried out according to the U.S. Patent, however, applies to a high twisted cord that was treated at 220° C. while subjected to a relatively high tension (0.5–1.0 g/d).

I claim:

1. A process for the manufacture of fibers from a polyamide consisting essentially of poly-p-phenylene terephthalamide, by spinning a spinning mass having a temperature of 20°–120° C. and consisting essentially of a mixture of concentrated sulphuric acid having a strength of at least 96% by weight and, calculated on the weight of the mixture, at least 15% of polyamide having an inherent viscosity of at least 2.5, the spinning mass being downwardly extruded into a coagulation bath from a spinneret whose efflux side is positioned in a gaseous inert medium and shortly above the liquid surface of the coagulation bath, characterized in that the spinning mass is prepared by the successive steps of cooling the concentrated sulphuric acid to below its solidifying point, combining the sulphuric acid thus cooled and the polyamide and intermixing the two substances into a solid state mixture, and heating the resulting solid state mixture to spinning temperature.

2. A process according to claim 1, characterized in that the sulphuric acid cooled down to below its solidifying point has a temperature lower than 0°.

3. A process according to claim 1 or 2, characterized in that in the preparation of the spinning mass the concentrated sulphuric acid is brought into a finely divided state and subsequently combined with finely divided polyamide and mixed.

4. A process according to claim 1 or 2, characterized in that in the preparation of the spinning mass liquid concentrated sulphuric acid is brought into a vessel provided with a cooling device and a stirrer and cooled to below its solidifying point until it has completely changed into a finely divided solid mass, to which subsequently the required amount of finely divided polyamide is added and the two solid substances are intermixed until a homogeneous solid state mixture is obtained.

5. A process according to claim 1 or 2, characterized in that in the preparation of the spinning mass a thin layer of liquid concentrated sulphuric acid is applied to the surface of a cooled roll, on which it is allowed to cool to below its solidifying point and the solidified layer is removed from the roll surface by means of a scraping device.

6. A process according to claim 1 or 2, characterized in that the polyamide is poly-p-phenylene terephthalamide having an inherent viscosity of at least 3.5.

7. A process according to claim 1 or 2, characterized in that the concentrated sulphuric acid has a strength of 98–100% by weight.

8. A process according to claim 1 or 2, characterized in that as concentrated sulphuric acid an azeotropic mixture of sulphuric acid and water is used.

9. A process according to claim 1 or 2, characterized in that calculated on its total weight, the spinning mass contains 16–21% of the polyamide.

10. A process according to claim 1 or 2, characterized in that the temperature of the spinning mass is 70°–100° C.

11. A process according to claim 1 or 2, characterized in that before the mixture prepared from sulphuric acid and polyamide is heated to spinning temperature, the gaseous constituents present are entirely or largely removed from the solid state mixture.

12. A process according to claim 1 or 2, characterized in that the coagulation bath consists of dilute aqueous sulphuric acid having a concentration of 0–40% by weight.

13. A process according to claim 1 or 2, characterized in that the temperature of the coagulation bath is 0°–25° C.

14. In a process for making a poly-p-phenylene terephthalamide fiber or film which comprises spinning a substantially homogeneous poly-p-phenylene terephthalamide and acid solid mixture into a non-coagulating inert gaseous atmosphere, drawing the resulting filament to orient the chain molecules through the said inert atmosphere into a coagulating bath, washing the resulting fiber to remove acid therefrom, and drying the washed fiber, the step which comprises mixing poly-p-phenylene terephthalamide with solid particulate sulfuric acid to form the said substantially homogeneous solid mixture with at least about 15% by weight, based on the weight of the mixture, of poly-p-phenylene terephthalamide.

* * * * *